United States Patent [19]

Svoboda

[11] 4,266,802

[45] May 12, 1981

[54] SKI BRAKE

[75] Inventor: Josef Svoboda, Schwechat, Austria

[73] Assignee: TMC Corporation, Baar/Zug, Switzerland

[21] Appl. No.: 14,273

[22] Filed: Feb. 22, 1979

[30] Foreign Application Priority Data

Feb. 22, 1978 [AT] Austria ..... 1297/78

[51] Int. Cl.[3] ..... A63C 7/10

[52] U.S. Cl. ..... 280/605

[58] Field of Search ..... 280/604, 605; 188/5

[56] References Cited

U.S. PATENT DOCUMENTS

| | | | |
|---|---|---|---|
| 3,715,126 | 2/1973 | Schwarz | 280/605 |
| 4,076,274 | 2/1978 | Saloman | 280/605 |
| 4,101,145 | 7/1978 | Korger | 280/605 |
| 4,124,223 | 11/1978 | Kubelka | 280/605 |

FOREIGN PATENT DOCUMENTS

| | | | |
|---|---|---|---|
| 1010468 | 6/1951 | France | 280/605 |
| 984272 | 7/1951 | France | 280/605 |

*Primary Examiner*—Charles A. Marmor

*Attorney, Agent, or Firm*—Blanchard, Flynn, Thiel, Boutell & Tanis

[57] ABSTRACT

A ski brake having at least one braking leg, which is pivotal by a force applied by a ski boot or by a sole plate to a pedal about an axle, which extends substantially at a right angle with respect to the longitudinal axis of the ski in a mounting member which is secured to the ski, between a braking position against a spring force into a retracted position. The braking leg has a bent segment therein which extends from the snow engaging portion of the braking leg toward the longitudinal axis of the ski. The braking leg is held totally above the upper surface of the ski and within the width of the ski in the retracted position of the ski brake by the pedal which is stepped down upon by the ski boot or by the sole plate. In the braking position of the ski brake, the braking leg is held lying next to the ski edge and the braking leg projects below the running surface of the ski. The braking leg is pivotal about a swivel shaft which extends in longitudinal direction of the ski. The braking leg has a cam eccentrically mounted thereon and operatively cooperates with a stop to effectively swivel the braking leg to a position within the width of the ski in response to a force moving the pedal toward the upper surface of the ski.

12 Claims, 10 Drawing Figures

SKI BRAKE

FIELD OF THE INVENTION

The invention relates to a ski brake having at least one, preferably with two braking legs, pivotal by a force applied by a ski boot or by a sole plate to a pedal about an axis of an axle, which extends substantially at a right angle with respect to the longitudinal axis of the ski in a mounting member secured to a ski, between a braking position against a spring force into a retracted position, wherein each braking leg has a segment which extends from the snow engaging portion of the braking leg toward the longitudinal axis of the ski, and wherein the individual braking legs are supported totally above the upper surface of the ski and within the width of the ski in the retracted position of the ski brake by the pedal which is stepped down upon by the ski boot or by the sole plate and in the braking position of the ski brake the individual braking legs are supported so as to extend next to the lateral edges of the ski and project below the running surface of the ski, and wherein each braking leg has at least one further bent segment which follows the first segment and extends substantially parallel with respect to the longitudinal axis of the ski brake, which bent segment is at the same time the swivel shaft of the entire braking leg, as is disclosed in my earlier application Ser. No. 6389, filed June 25, 1979.

BACKGROUND OF THE INVENTION

According to my aforesaid earlier application, a ski brake of the above-mentioned type, which is described for example in Austrian Pat. No. 305 844 or in the associated U.S. Pat. No. 3,715,126 (FIGS. 7 to 9), is improved such that only the position of the braking legs is changed, when the ski brake is swung from the braking position into the retracted position or vice versa. This task is solved in an advantageous manner in my earlier application. A two-part pedal is held by two legs of its stepping bar on the axle of the ski brake, and the braking legs are arranged extending through the axle.

The present invention has the purpose of simplifying the solution which is known from my earlier application with respect to the arrangement of the pedal, and the construction of the braking legs and their operation by the pedal.

The set purpose is inventively attained by the further bent segment having at its end which is remote from the axle a cam, which is eccentrically supported with respect to the swivel shaft for the individual braking legs, and which cam is held in the retracted position of the ski brake by a ski-fixed stop with the associated braking leg in a position which is swung at 90° in relationship to the braking position of the ski brake.

Due to the fact that each braking leg has an eccentrically supported cam, through which it can be swung at 90° during a pressing down of the pedal caused by an engagement thereof with a ski-fixed stop, a separate construction between the individual braking legs and the pedal is not needed in order to effect the swivel movement. The construction of a ski-fixed stop is very simple since same can, according to a further characteristic of the invention, be a part of the existing mounting member.

Further advantages, details and inventive characteristics of the invention are described more in detail with reference to the drawings, which illustrate one exemplary embodiment.

BRIEF DESCRIPTION OF THE DRAWINGS

In the drawings:

FIGS. 1 to 6 illustrate an inventive ski brake in three positions, each in associated views, wherein FIGS. 1 and 2 illustrate respectively a side view, partly in cross section, and a top view of the ski brake in the braking position, FIGS. 3 and 4 illustrate respectively a side view, partly in cross section, and a top view of the ski brake in the first stage of pressing down prior to a swivelling of the braking mandrels, and FIGS. 5 and 6 illustrate respectively a side view, partly in cross section, and a top view of the ski brake in the retracted position of the ski brake with the braking mandrels having been swivelled;

DETAILED DESCRIPTION

Figure 1:
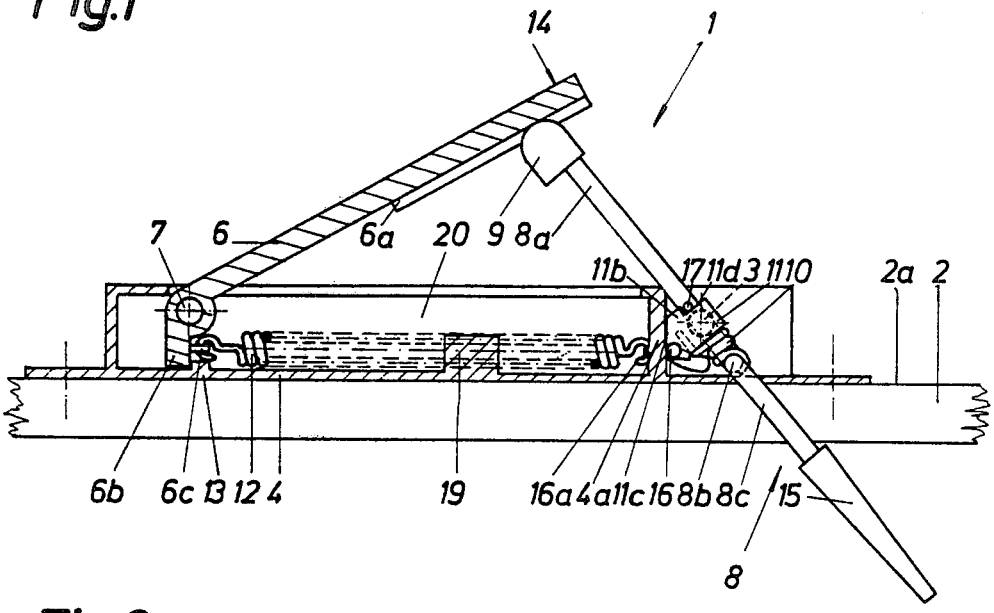

The individual structural parts utilize, in as far as possible, the same reference numerals, which have been used in my earlier application Ser. No. 6389, filed June 25, 1979. Also the same terminology utilized herein, in as far as possible, is the same as in my earlier application.

Figure 2:
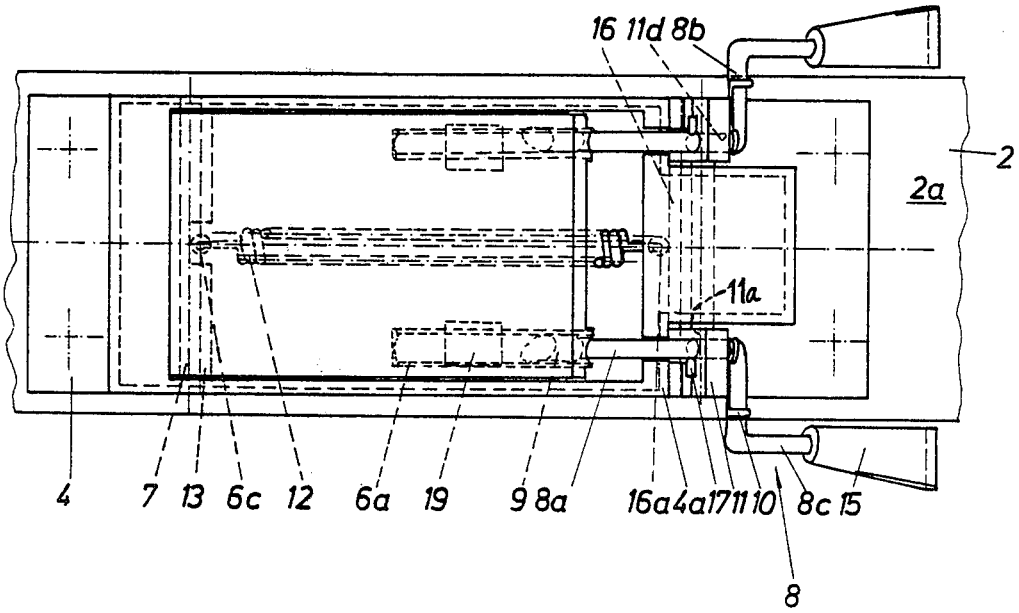

A ski brake, which is identified as a whole by the reference numeral 1, is in the present exemplary embodiment pivotally supported for movement about an axle 3 provided on a ski-fixed mounting member 4 secured to the upper surface 2*a* of a ski. The ski brake 1 has, arranged symmetrically with respect to the longitudinal axis of the ski, a pair of braking legs 8 which are illustrated in the braking position of the ski brake 1 in FIGS. 1 and 2 and project over the two lateral edges of the ski and extend below the bottom surface of the ski 2. Each braking leg 8 has with a segment 8*c* extending parallel with respect to the longitudinal axis of the ski, which segment has a braking blade 15 secured to its free end. A first segment 8*b* is connected to the end of the segment 8*c* remote from the blade 15. A further segment 8*a* is connected to the segment 8*b*. The further segment 8*a* is a swivel shaft for the entire braking leg 8. However, it is also conceivable to construct the leg segment 8*a* in two parts or separately and to connect them to one another, for example, by a common sleeve member.

Figure 3:
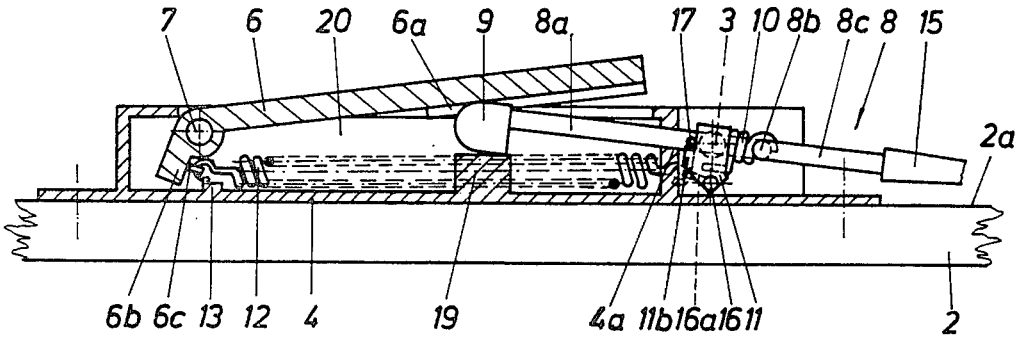

Bearing blocks 11 are provided on the axle 3 for supporting the braking legs 8 for swivelling movement, which bearing blocks are also pivotal with the axle 3 or with the two braking legs 8. That is, the individual bearing blocks 11 each have a first opening 11*a* for receiving the axle 3 therein, and a second opening 11*d* lid for receiving the swivel shaft segment 8*a* of the braking leg therein. The two openings 11*a* and 11*d* do not intersect in the individual bearing blocks 11. As one can best recognize from FIGS. 1 and 3, each bearing block 11 has a shoulder 11*b* which defines a stop for a pin 17 secured to the braking leg 8 and at least one sloped stop surface 11*c*. According to FIG. 1, the stop surface 11*c* rests on a vertically extending wall 4*a* on the mounting member 4. For example, it will be recognized in FIG. 3, that due to a pivoting of the axle 3, the sloped stop surface 11*c* of the bearing block 11 will separate from the wall 4*a* of the mounting member 4. Each braking leg 8 is biassed by a torsion spring 10 in relationship to the opening 11*d* of the bearing block 11, which torsion spring 10 urges the individual braking legs 8 toward the position illustrated in FIGS. 1 and 2, namely into the braking position of the ski brake 1. A cylindrical rod 16 is provided in the individual bearing blocks 11 on a side thereof remote from the axle 3 and is supported in the mounting member 4, the role of which will be discussed hereinbelow.

A pedal 6 is provided for operating the two braking legs 8, which pedal can be pivoted about an axle 7, which extends substantially at a right angle with respect to the longitudinal axis of the ski. The pedal 6 has two laterally spaced guideways 6*a* thereon into each of which projects a cam 9 secured to the end of the segment 8*a* remote from the segment 8*b* of each of the individual braking legs 8. In this manner, a secure guiding of the braking legs 8 in the pedal 6 is assured. Furthermore, the pedal 6 has an extension 6*b* which engages a stop or an abutment 13 to assure a predetermined angular position of the pedal 6 in the braking position of the ski brake 1. Since due to the sloped stop surface 11*c* on the two bearing blocks 11 the angular position of the individual braking legs 5 can be fixed with respect to the upper surface 2*a* of the ski, the angle which is defined by the two braking legs 8 and the pedal 6 can also be determined. In this manner care is taken that an automatic locking between these structural parts is not created. The two braking legs 8 and the pedal 6 are biassed by a common tension spring 12. The longitudinal axis of the tension spring 12 extends substantially parallel to the longitudinal axis of the ski and is supported at its one end in an eyelet 16*a* on the cylindrical bar 16 and at its other end in an eyelet 6*c* on the extension 6*b* of the pedal 6; the eyelet 16*a* can also be constructed of the same material as the cylindrical rod 16. Since the cylindrical rod 16 can rotate in the two bearing blocks 11, it is assured that this end of the spring 12 is independent of the position of the two bearing blocks 11 and is always aligned with the positive direction of the force of the spring 12. The ski boot or a corresponding sole plate which is used to manipulate the ski brake 1 is only schematically indicated by the arrow 14 in FIG. 1.

The mounting member 4 is secured to the upper surface 2*a* of the ski by means of screws, only the center lines of which are indicated. The mounting member 4 has a recess 20, into which in the retracted position of the ski brake 1 are received the swivel shaft segments 8*a* of the braking legs 8, the cams 9 and most of the pedal 6. The spring 12 and a pair of stops 19 are arranged, in each position of the ski brake, in the recess 20. One will recognize from FIG. 5 that the pedal 6 projects also in the retracted position of the ski brake a certain amount above the upper surface of the mounting member 4. As a result, it is indicated and assured that the ski boot will press the pedal 6 down during downhill skiing and also during standstill, in other words, the pedal, caused by the spring 12, will constantly load or engage the ski boot. A safe operation of the ski brake during a release operation is assured by this construction.

Figure 4:
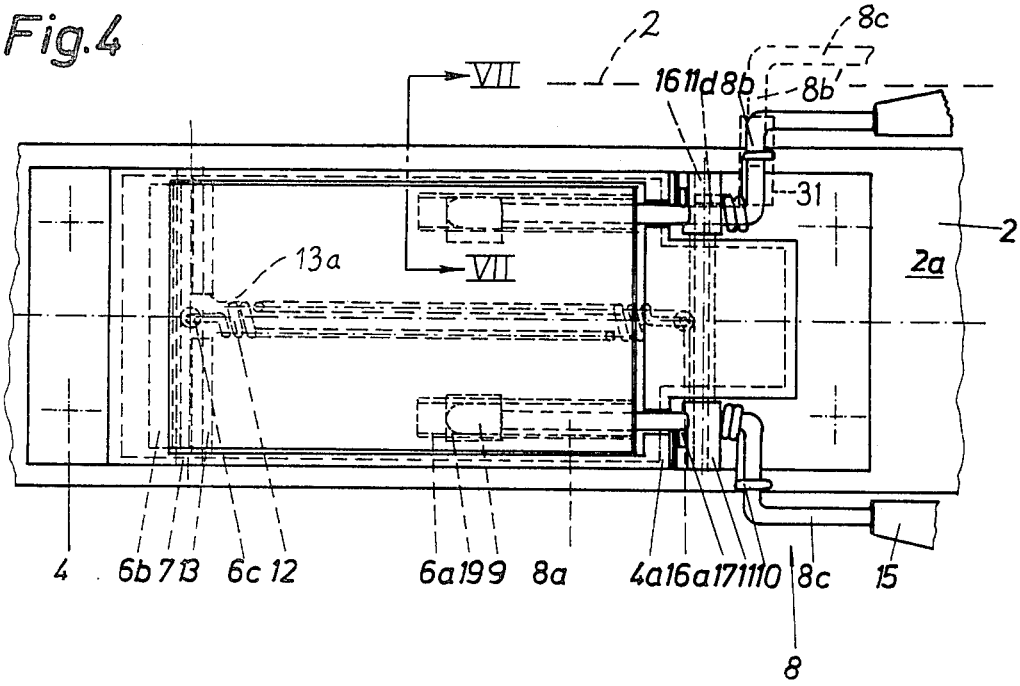
Figure 5:
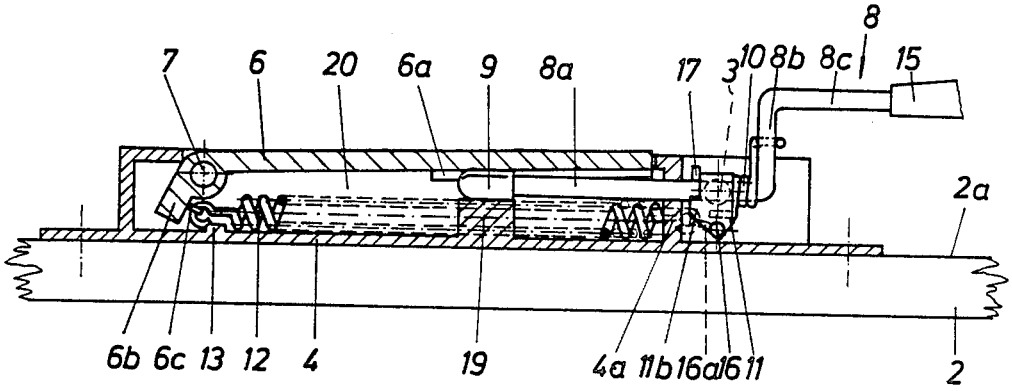
Figure 6:
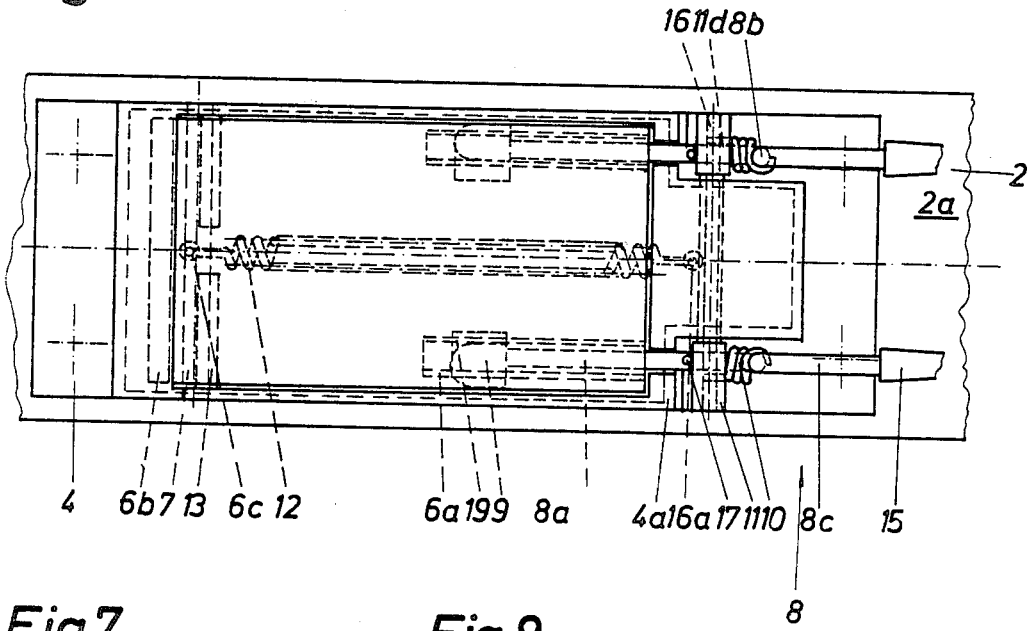
Figure 7:
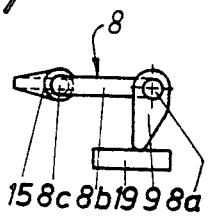
FIGS. 7 and 8 each illustrate a front view of the ends of the braking legs, wherein FIG. 7 corresponds with the position of FIGS. 3 and 4 as seen in the direction VII—VII in FIG. 4 and FIG. 8 corresponds with the position according to FIGS. 5 and 6 as seen in the direction VIII—VIII in FIG. 8 and FIGS. 9 and 10 illustrate respectively a side view, partly in cross section, and a detail of a ski brake with an adjusting stop for different length ski boots.
Figure 8:
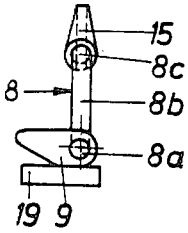

FIGS. 7 and 8 illustrate a braking leg 8 as seen in the indicated directions in FIGS. 4 and 6. A comparison of FIGS. 7 and 8 reveals that each cam 9 initially engages in the swung-down position of the pedal 6 according to FIGS. 3 and 4 the upper surface of the associated one of the stops 19, however, more completely engages the stops when the cam 9 is turned or rotated about the axis of the swivel shaft 8*a* as shown in FIGS. 5 and 6. It will be readily understood that the same operation takes place with both braking legs 8. Since each cam 9 is located at the free end of each of the swivel shafts 8*a* of the braking leg 8, a swivelling of the individual cams 9 will cause the entire braking leg 8 and the braking blade 15 to be swung at the same time. A comparison of the position of the individual braking blades 15 in FIGS. 3 and 4 on the one hand and in FIGS. 5 and 6 on the other hand will further facilitate a clear recognition of this method of operation. A movement will take place in the opposite direction during a release operation caused by the spring bias provided by the springs 10 and 12.

To enable an adjustment to different width skis, it is possible to construct the individual braking legs 8 according to the invention with different length first segments 8*b*′ (see broken lines in FIG. 4), wherein they can then be connected through their second segments 8*a* of the associated braking leg 8 through a sleeve 31 or the like. The sleeve can be fixed if desired and preferably to the end of the swivel shaft segment 8*a* of the braking leg 8. It is sufficient in this case to pull the individual braking mandrels from the sleeve and to place the required other braking mandrels into the sleeve. Both of the swivel shafts 8*a* of the braking mandrels 8 can be locked in the sleeve, for example, by means of a flexible pin. Such a construction should also be understandable without any further discussions for the man skilled in the art, particularly in view of my aforesaid earlier filed application Ser. No. 6389.

The invention is not limited to the illustrated exemplary embodiment. Further modifications are possible without departing from the scope of the invention. For example, it is possible to arrange the spring which holds the individual braking legs swung into the braking position of the ski brake, in the region beneath the pedal and same may preferably bias the cam 9. In the illustrated exemplary embodiment, the stop 13, which determines the position of the pedal 6 in the braking position of the ski brake 1, is constructed of the same material as the mounting member 4, is integral therewith and extends continuously laterally of the mounting member except for the gap 13*a* which the spring 12 occupies. However, one can also provide a stop 13 which is adjustable relative to the mounting member 4 in longitudinal direction of the ski and can be locked in the desired position with respect to the mounting member. By adjusting the stop, it is possible to adjust the angular position of the pedal to different length ski boots.

Figure 9:
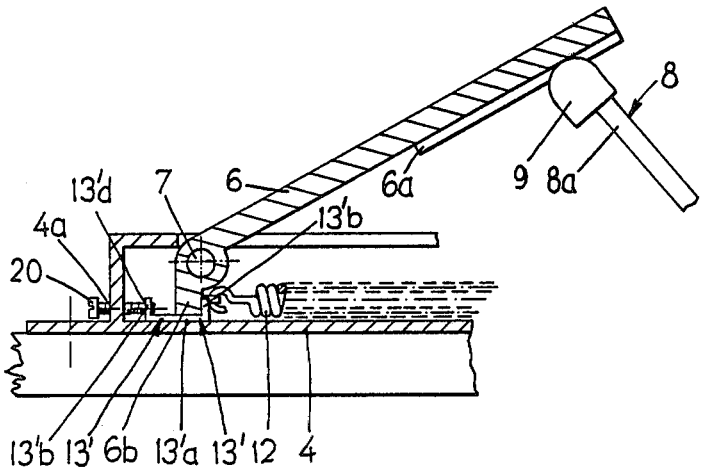
Figure 10:
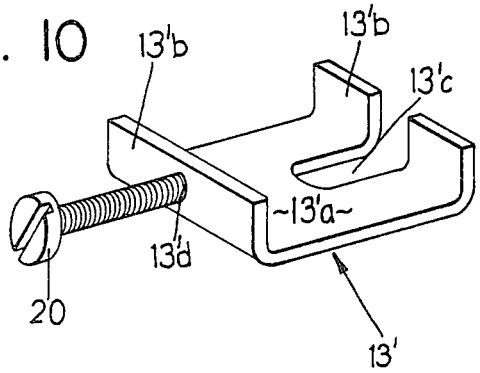

More specifically, FIGS. 9 and 10 show an adjusting stop 13′. The adjusting stop 13′ contains a base plate 13′*a* and two side parts 13′*b*. Both of these side parts 13′*b* extend perpendicularly to the base plate 13′*a* directed away from the upper surface of the ski 2. The side parts 13′*b* are arranged opposite each other and normal to the longitudinal axis of the ski 2.

The baseplate 13′*a* of the movable stop 13′ has a rectangular recess 13′*c*. This recess 13′ opens outwardly at its end belonging to the side part 13′*b* adjacent the pedal 6.

In the side part 13′*b* which is remote from the pedal 6 and is adjacent the top of the ski 2 there is a hole 13′*d*. A socket-head cap screw is received in the hole 13*d*. The screw 20 is on its end which engages the adjusting stop riveted so that it is turnable about its longitudinal axis remaining in its engaging position. In the mounting member 4 there is provided a tapped hole 4*a* for the screw 20. The head of the screw 20 is freely operable. The tapped hole 4*a* is arranged in the mounting member 4 and at a level to enable the adjusting stop 13′ to be slidingly arranged on the upper surface of the mounting member 4.

The adjusting stop 13′ is arranged in the mounting member 4 so that it limits the swinging movement of the extension 6*b* of the pedal 6 counterclockwise, see FIG. 9. By a swinging movement of the pedal 6, the end of the tension spring 12 moves without any impediment in the recess 13′*c* of the adjusting stop 13′.

By operating the socket-head cap screw 20, the adjusting stop 13′ moves in the longitudinal direction of the ski 2. This movement facilitates an adjustment of the pedal 6 to different angular positions. The free end of the extension 6*b* can be rounded as shown in dotted lines to enable an impediment free swinging movement.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A brake for use on a ski, comprising:

a mounting member adapted to be mounted on said ski;

an axle and first support means on said mounting member supporting said axle for rotation and about an axis which extends at a right angle to the longitudinal axis of said ski;

bearing means mounted on said axle and being movable therewith;

at least one brake leg means having a first segment extending generally parallel to the longitudinal axis of said ski, a second segment connected at one end thereof to said first segment and extending generally perpendicularly to said first segment and a third segment connected to the other end of said second segment and extending perpendicularly to said second segment and being longitudinally offset from said first segment, said first segment being received in said bearing means and thereby supported for rotation both about the longitudinal axis of said first segment and said axis of said axle between (1) a braking position wherein said third segment extends along the lateral edges of said ski and beneath the plane of the lower surface of said ski and said first segment extends above the plane of the upper surface of said ski and (2) a retracted position wherein said first and third segments extend above said upper surface of said ski;

a pedal and second support means for pivotally supporting said pedal on said mounting member, said pedal being movable about an axis spaced longitudinally along the length of said ski from said axle and extending parallel to said axis of said axle;

a cam member fixedly secured to said first segment adjacent said end and extending radially outwardly therefrom;

resilient means operatively connected to and extending between said pedal and said brake leg means for urging said pedal to a position inclined at an angle to the upper surface of said ski with the end of said pedal remote from the pivot support therefor overlaying an end of said first segment remote from said connection to said second segment;

guide means on said pedal operatively slidingly engaging said cam member; and stop means on said mounting member positioned so as to be engaged by said cam member when said pedal and said brake leg means are pivoted about said axis of said axle from said braking position to said retracted position, said stop means, upon engagement thereof by said cam member, effecting a movement of said cam member and, consequently said brake leg means in said bearing means about said longitudinal axis of said first segment thereby resulting in a movement of said third segment inwardly of said lateral edges of said ski.

2. The ski brake according to claim 1, wherein a spring is provided on said brake leg means and said axle for effecting a continual rotational urging of said brake leg means about said longitudinal axis of said first segment so that said third segment extends along said lateral edges of said ski.

3. The ski brake according to claim 2, wherein said spring which loads each braking leg means is constructed as a torsion spring supported at its one end on said bearing means and with its other end on said second segment of said braking leg means.

4. The ski brake according to claim 1, wherein said stop means is an integrally formed part of said mounting member and comprises a stop member struck from the material of said mounting member, said stop member extending upwardly away from said upper surface of said ski.

5. The ski brake according to claim 1, wherein said guide means includes a guideway which extends in the longitudinal direction of said pedal on the underside of said pedal.

6. The ski brake according to claim 1, wherein said ski brake has two braking leg means, wherein each braking leg means has a pin thereon which determines the range of swing of said braking leg means about said axis of said first segment, wherein said bearing means includes a bearing block having a step forming an abutment for said pin, and wherein at least one outer surface of said bearing block has a sloped stop surface thereon through which the angle adjustment of said braking leg means is determined.

7. The ski brake according to claim 5, wherein said mounting members has an upstanding wall, said sloped surface of said bearing block engaging said upstanding wall to thereby limit the upwardly inclined angle of said brake leg means in said braking position thereof.

8. The ski brake according to claim 1, wherein said resilient means includes a tension spring connected at its one end to said pedal adjacent said second support means and at its other end in an eyelet of a rod which is supported freely rotatably in said bearing means and extends transversely of the longitudinal axis of said ski.

9. The ski brake according to one of th claims 1 to 8, wherein said braking leg means include means for facilitating an adjustment to different ski widths, said means having different length second segments which are connectible to said first segments by a fastening member, which fastening member is fixedly secured to the end of said first segment to said braking leg means, immediately adjacent said second segments.

10. The ski brake according to claim 1, wherein said braking leg means includes a pair of braking legs each having said first, second and third segments and extending along a respective one of said lateral edges of said ski, wherein said guide means includes a pair of parallel guideways on the underside of said pedal, each of said first segments having one of said cam members thereon, wherein said resilient means is fastened at its one end to the underside of said pedal adjacent said second support means between said guideways and centrally between said cam members.

11. The ski brake according to claim 1, wherein said second support means includes a base plate slidably disposed on said mounting plate and adjusting means for adjusting the relative position of said base plate on said mounting plate, said base plate having said pedal pivotally supported thereon.

12. The ski brake according to claim 1, wherein said pedal has an extension thereon on the opposite side of said pivot axis therefor from the part of said pedal stepped down upon by a ski boot, wherein said mounting member has an abutment thereon, wherein said resilient means is a tension spring being secured at one end thereof to said extension and at the other end to said braking leg means to urge said extension into engagement with said abutment.

* * * * *

UNITED STATES PATENT AND TRADEMARK OFFICE

CERTIFICATE OF CORRECTION

PATENT NO. : 4 266 802

DATED : May 12, 1981

INVENTOR(S) : Josef Svoboda

It is certified that error appears in the above—identified patent and that said Letters Patent is hereby corrected as shown below:

Col. 5, line 30; before "brake" insert ---ski---.

Col. 6, line 51; change "members" to ---member---.

line 61; change "th" to ---the---.

change "8" to ---7---.

line 67; after "segment" change "to" to ---of---.

Signed and Sealed this

*Eighteenth* Day of *August 1981*

[SEAL]

*Attest:*

GERALD J. MOSSINGHOFF

*Attesting Officer*

*Commissioner of Patents and Trademarks*